US010681977B2

(12) United States Patent
Green

(10) Patent No.: US 10,681,977 B2
(45) **Date of Patent: *Jun. 16, 2020**

(54) SHELVING POST AND AN ADJUSTABLE SHELVING SYSTEM

(71) Applicant: Mills Display Limited, London (GB)

(72) Inventor: Daniel Green, Warriewood (AU)

(73) Assignee: Mills Display Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/534,418

(22) Filed: Aug. 7, 2019

(65) Prior Publication Data

US 2019/0357674 A1 Nov. 28, 2019

Related U.S. Application Data

(63) Continuation of application No. 15/860,892, filed on Jan. 3, 2018, now Pat. No. 10,413,056.

(51) Int. Cl.

| | |
|---|---|
| ***A47B 57/54*** | (2006.01) |
| ***A47F 3/06*** | (2006.01) |
| ***A47F 5/10*** | (2006.01) |
| ***A47B 57/56*** | (2006.01) |
| ***A47B 96/02*** | (2006.01) |

(52) U.S. Cl.

CPC ..... *A47B 57/545* (2013.01); *A47B 57/562* (2013.01); *A47B 96/021* (2013.01); *A47F 3/063* (2013.01); *A47F 5/103* (2013.01)

(58) Field of Classification Search

CPC ..... A47F 5/00; A47B 57/30; A47B 57/42; A47B 57/56

USPC ..... 108/107, 108, 147.17; 211/208, 192, 211/191; 312/257.1

See application file for complete search history.

(56) References Cited

U.S. PATENT DOCUMENTS 2,691,502 A * 10/1954 Jones ..... A47B 96/1416 248/243
3,151,745 A * 10/1964 Reilly ..... A47B 57/402 211/191
3,352,584 A * 11/1967 Engel ..... A47B 57/402 403/316
3,475,044 A * 10/1969 Konstant ..... E04G 1/12 403/217
3,592,345 A * 7/1971 Featherman ..... F16B 12/34 211/191
3,647,079 A * 3/1972 Ohlin ..... A47B 57/402 211/192
3,672,515 A * 6/1972 Rous ..... A47B 57/402 211/191

(Continued)

*Primary Examiner* — Jose V Chen

(74) *Attorney, Agent, or Firm* — Cooper Legal Group, LLC; Ronald M. Kachmarik

(57) ABSTRACT

Shelving posts and shelving supports for use in adjustable shelving systems that reduce the space lost to the posts and shelf supports. The shelving posts do away with bulky RHS and SHS shaped posts with apertures formed therein and replace them with planar vertical member or members that are attached to one or more fins which extend perpendicularly from the planar vertical member or members. The fins provide structural support for supporting shelves and the goods that will be placed on them. The fins are orientated such that they sit between adjacent shelves. Shelf supports include flat planar shelf arms. The Shelf supports have a vertical stop which abuts a fin of the shelving post to provide additional support to the shelves. In addition, the shelf supports also have a perpendicular planar portion which also provides additional rigidity and strength to the shelf support.

6 Claims, 17 Drawing Sheets

(56) References Cited

U.S. PATENT DOCUMENTS

| | | | | | |
|---|---|---|---|---|---|
| 3,701,325 | A * | 10/1972 | Fenwick | A47B 57/045 | 108/1 |
| 3,730,468 | A * | 5/1973 | Magnusen | A47B 57/56 | 248/246 |
| 3,993,002 | A * | 11/1976 | Stroh | A47F 5/13 | 108/108 |
| 4,067,445 | A * | 1/1978 | Derclaye | A47B 57/402 | 211/191 |
| 4,122,955 | A * | 10/1978 | Celms | A47F 5/13 | 108/108 |
| 4,314,685 | A * | 2/1982 | Schwan | A47B 57/04 | 108/107 |
| 4,821,649 | A * | 4/1989 | Andersson | A47B 57/16 | 108/107 |
| 4,852,839 | A * | 8/1989 | Winter | A47B 57/485 | 248/220.42 |
| 4,949,648 | A * | 8/1990 | Miller | A47B 47/024 | 108/107 |
| 5,348,385 | A * | 9/1994 | Berg | A47B 57/04 | 108/108 |
| 5,377,851 | A * | 1/1995 | Asano | A47B 47/022 | 211/191 |
| 5,415,301 | A * | 5/1995 | Bruton | A47B 96/1416 | 211/183 |
| 6,112,913 | A * | 9/2000 | Rindoks | A47B 57/30 | 108/108 |
| 2004/0237853 | A1* | 12/2004 | Sholz | A47B 57/40 | 108/107 |
| 2009/0001039 | A1* | 1/2009 | Lin | A47B 57/26 | 211/208 |
| 2010/0252521 | A1* | 10/2010 | Chen | A47B 46/005 | 211/208 |

* cited by examiner

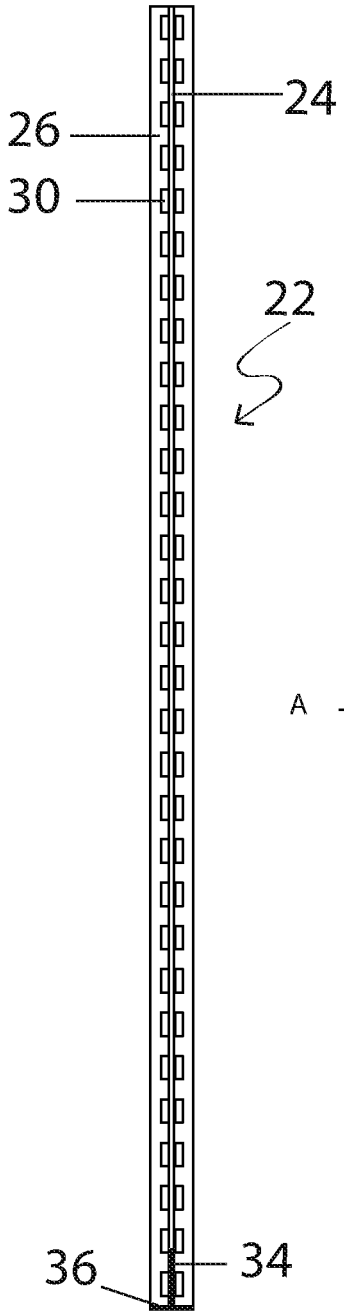
Fig. 4
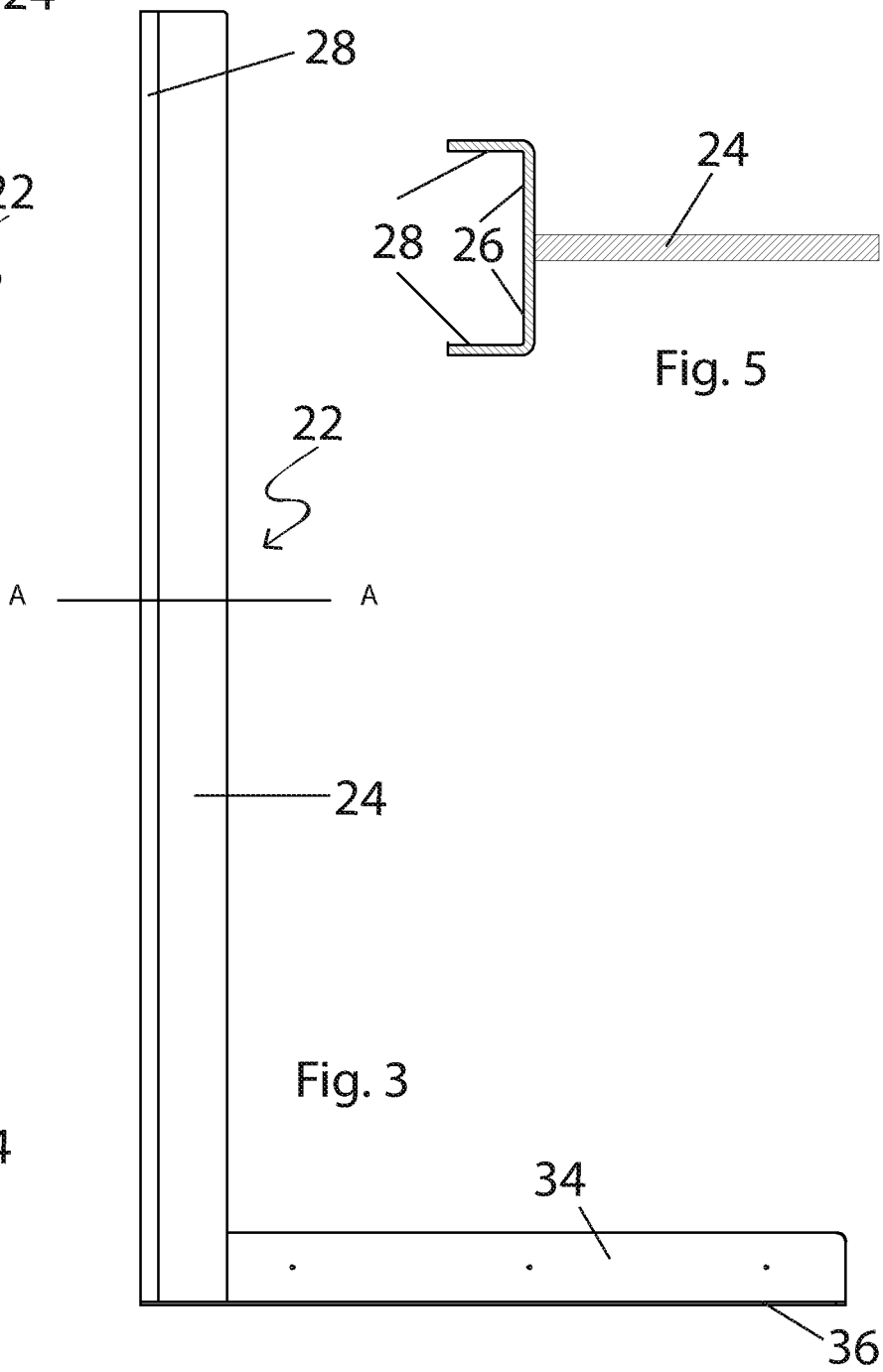
Fig. 3
Fig. 5
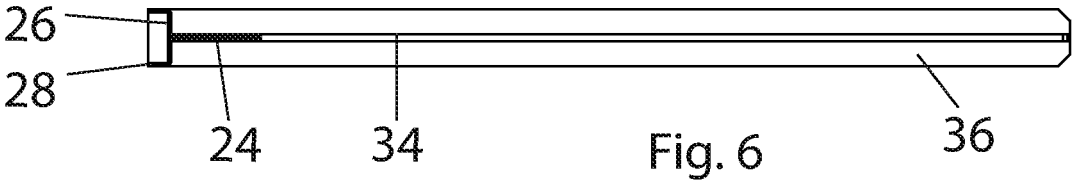
Fig. 6

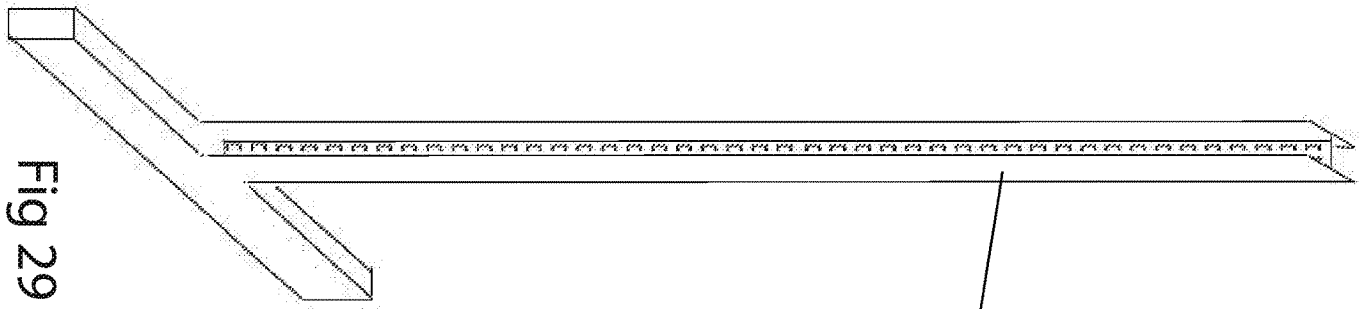
Fig 29
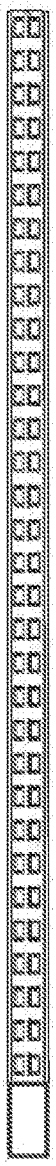
Fig 30
Fig 31
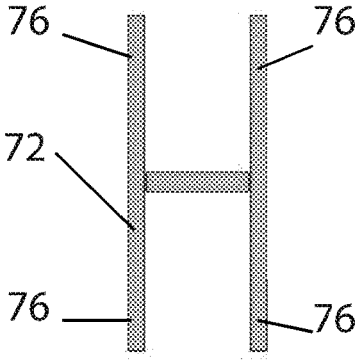

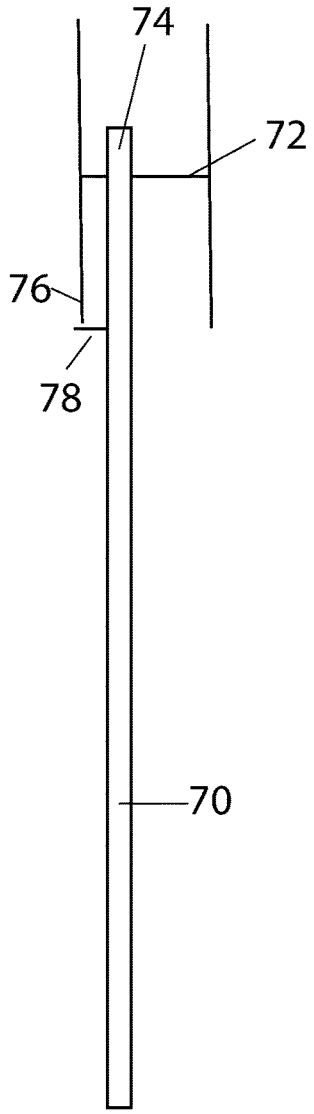
Fig 34
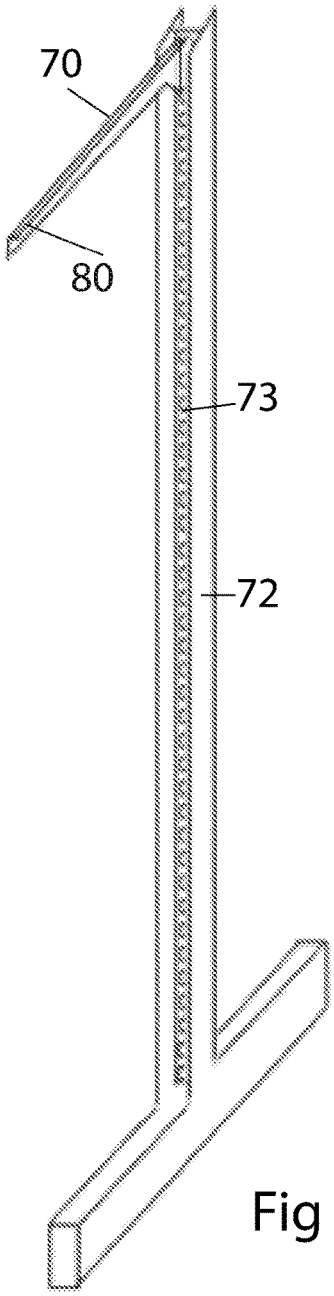
Fig 35
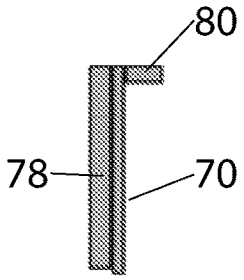
Fig 36
Fig 38
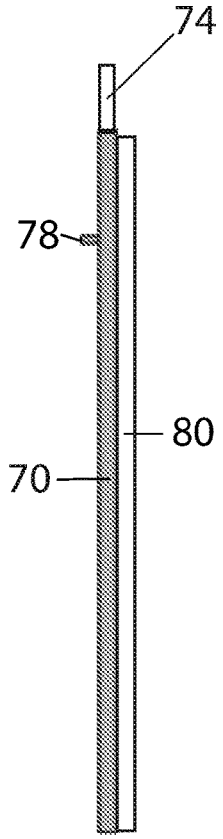
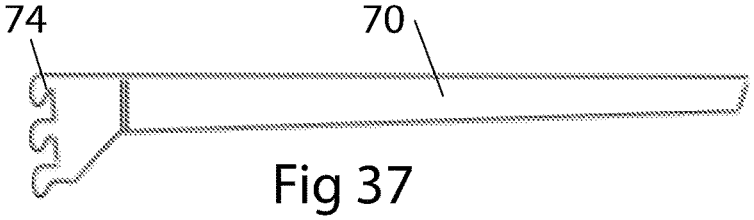
Fig 37

SHELVING POST AND AN ADJUSTABLE SHELVING SYSTEM

TECHNICAL FIELD

The invention relates to shelving posts utilised in adjustable shelving systems. More specifically the invention relates to improved shelving systems for displaying product in retail environments and in particular, supermarkets and other such stores.

BACKGROUND ART

Retail environments such as supermarkets employ shelving systems for displaying merchandise for sale. Due to the ever changing nature of products sold by stores, shelving systems employing adjustable shelving are the dominant and most common type of shelving systems used in this area. This is because a retailer may wish to reconfigure one or more sections of the shelves to accommodate products that would otherwise not fit in the pre-existing shelving fit out.

Adjustable shelves often are supported by a single pair of shelving posts which differentiate them from those shelving systems that incorporate four posts and rectangular shelves attached to all four posts. The utilisation of just a single pair of posts at the rear of the shelves allow for more unimpeded access to the products on the shelves.

However the utilisation of a single pair of posts to support shelves brings with it a set of problems in how to support the shelves which may have to bear considerable amount of heavy products. For this reason, and others, the usual manner of constructing a shelving post is to utilise rectangular hollow section (RHS) or square hollow section (SHS) steel members which have apertures cut into them for receiving the connecting lugs that are connected to the shelf to be supported by the post. Due to the structural requirement for supporting heavy loads, the cross section of the RHS or SHS sections are often considerable. This leads to a significant disadvantage which is that the width and depth of the SHS or RHS steel posts reduces the available shelving space. In particular it often means that there is a rear section of the supported shelf that extends between the posts that is of a reduced width when compared with the width of the front section of the shelf. Due to the depth of the posts, this restricted rear area of the shelf can be significant. For retailers, who tend to line products up in lines extending from the front of the shelf right to the rear of the shelf, this means that there will be product lines at either side of the shelf that can hold lesser quantities of product. More often than not, retailers leave a gap at each side of the shelf in front of the shelving posts. Considering that rows and rows of shelves are placed side by side, the loss of valuable retail space along a supermarket aisle due to the posts can be considerable.

Similarly, in some cases the shelf support arms that hook into conventional shelving posts are tapered such that there is little vertical extent to the portions of the arms that reach the front of the shelf and more often than not, quite a significant vertical extent to the support arms at the rear of the shelf where they hook into the posts. The significant vertical extent of the support arms at the rear of the shelf often means that product cannot be stacked below the shelf support arms due to their size.

It is an object of the present invention to produce a shelving post for utilisation within a shelving system that obviates or at least lessens the losses of retail space around the shelving posts or below the shelf support arms.

DISCLOSURE OF INVENTION

In a first aspect of the invention there is provided, a shelving post for use in supporting a shelf of an adjustable shelving system, the shelving post comprising:

(a) at least one vertical member wherein the vertical member has a planar portion that has a front and rear face, and contains a plurality of apertures formed therethrough for receiving lugs of a shelf support; and (b) at least one second vertical member comprising a fin connected to the first vertical member, wherein the fin extends perpendicularly from the first vertical member and provides structural support to the shelving post.

Preferably the fin divides the first vertical member into a first planar portion and a second planar portion wherein each planar portion has a plurality of apertures for receiving shelf support lugs.

Alternatively, there are at least two fins extending perpendicularly from the first vertical member and wherein the planar portion is located between the two fins.

Preferably the shelving post is adapted to have shelves attached to both sides of the first vertical member and wherein the two fins extend perpendicularly from a front face and also a rear face of the first vertical member.

More preferably the shelving post comprises at two vertical members, and wherein lugs of a shelf support are inserted via their front face of the planar portions of the two vertical members, and wherein the at least two vertical members are connected to fins on either side of the planar portions of the two vertical members, such that the faces of the vertical members are parallel and connected perpendicularly with the fins which extend either side of the two vertical members.

Preferably the shelving post is adapted to have shelves attached to both faces of the at least one vertical member and wherein the at least one second vertical member extends perpendicularly from the front and rear faces of the at least one vertical member.

More preferably the at least one vertical member has lug guards on either side of the rear face of the planar portion to prevent any inserted lugs from being dislodged.

Alternatively, the at least one vertical member planar portion is curved.

Preferably the vertical member is curved such that the rear face of the planar portion is concave, so that lugs inserted into the front face of the planar portion are protected from being dislodged.

Preferably, the at least one vertical member comprises a low profile hollow body with at least two planar surfaces, and wherein at least one fin extends perpendicularly from the front face of each planar portion of the two planar surfaces.

More preferably the distance or space between the two planar surfaces is less than the length of the fin or fins.

Still more preferably the distance or space between the two planar surfaces is less than half the length of the fin or fins.

Preferably the shelving post further comprises a base portion connected to the at least one first vertical member and at least one fin.

More preferably the apertures in the planar portion are arranged in columns.

Still more preferably the apertures are arranged in a single column between two fins.

Alternatively the apertures are arranged in a double column, between two fins.

According to a second aspect of the invention there is provided an adjustable shelving system comprising a shelving post in accordance with the first aspect of the invention together with a plurality of shelf supports that have a planar body having a plurality of lugs, wherein the shelf supports are supported by the lugs when inserted into the apertures of the shelving post.

The adjustable shelving system shelf support further comprises a vertical stop that is located on at least one side of the shelf support, wherein the vertical stop is adapted to abut one of the one or more fins, when inserted into the shelving post, so as to provide the shelf support with additional support.

Preferably the shelf support additionally comprises a second planar portion connected perpendicularly to the body and wherein the second planar portion provides additional rigidity to the plurality of shelf supports.

According to a third aspect of the invention there is provided a method of providing shelving of adjustable nature, wherein the method comprises providing a plurality of the shelving posts described above together with, at least, a plurality of shelf supports that are supported by lugs of the shelf supports in the apertures of the shelving posts.

According to a fourth aspect of the invention there is provided a method of providing a double sided shelf system, the method comprising providing a plurality of double sided shelving posts described above together with, at least, a plurality of shelf supports that are supported by lugs of the shelf supports in the apertures of the shelving posts.

BRIEF DESCRIPTION OF THE DRAWINGS

Reference is now made to the series of drawings in which exemplary embodiments of the invention are disclosed in which:

FIG. 3 is a side view of the embodiment of the shelving post of FIG. 2;

FIG. 4 is a front view of the embodiment of the shelving post of FIG. 2;

FIG. 5 is a cross section of the shelving post taken along lines A-A of FIG. 3;

FIG. 6 is a top view of the of the embodiment of the shelving post of FIG. 2;

FIG. 29 Is a perspective view of an eleventh embodiment of the shelving post;

FIG. 30 Is a front view of the shelving post of FIG. 29;

FIG. 31 Is a cross section of the shelving post of FIG. 29;

FIG. 34 Is a schematic top view of a further embodiment of a shelving system comprising a second embodiment of a shelf support and shelving post according to the eleventh embodiment of the shelving post;

FIG. 35 Is a perspective view of the shelving system if FIG. 34;

FIG. 36 Is a front view of a shelf support;

FIG. 37 Is a side view of the shelf support of FIG. 36;

FIG. 38 Is a top view of the shelf support of FIG. 36;

BEST MODE FOR CARRYING OUT THE INVENTION

There are three main aspects to the present invention. The first aspect is a shelving post that is adapted to be used in an adjustable shelving system. The second aspect is an adjustable shelving system incorporating the novel shelving post. The third aspect of the invention is a method of using the shelving post or adjustable shelving system.

Figure 1:
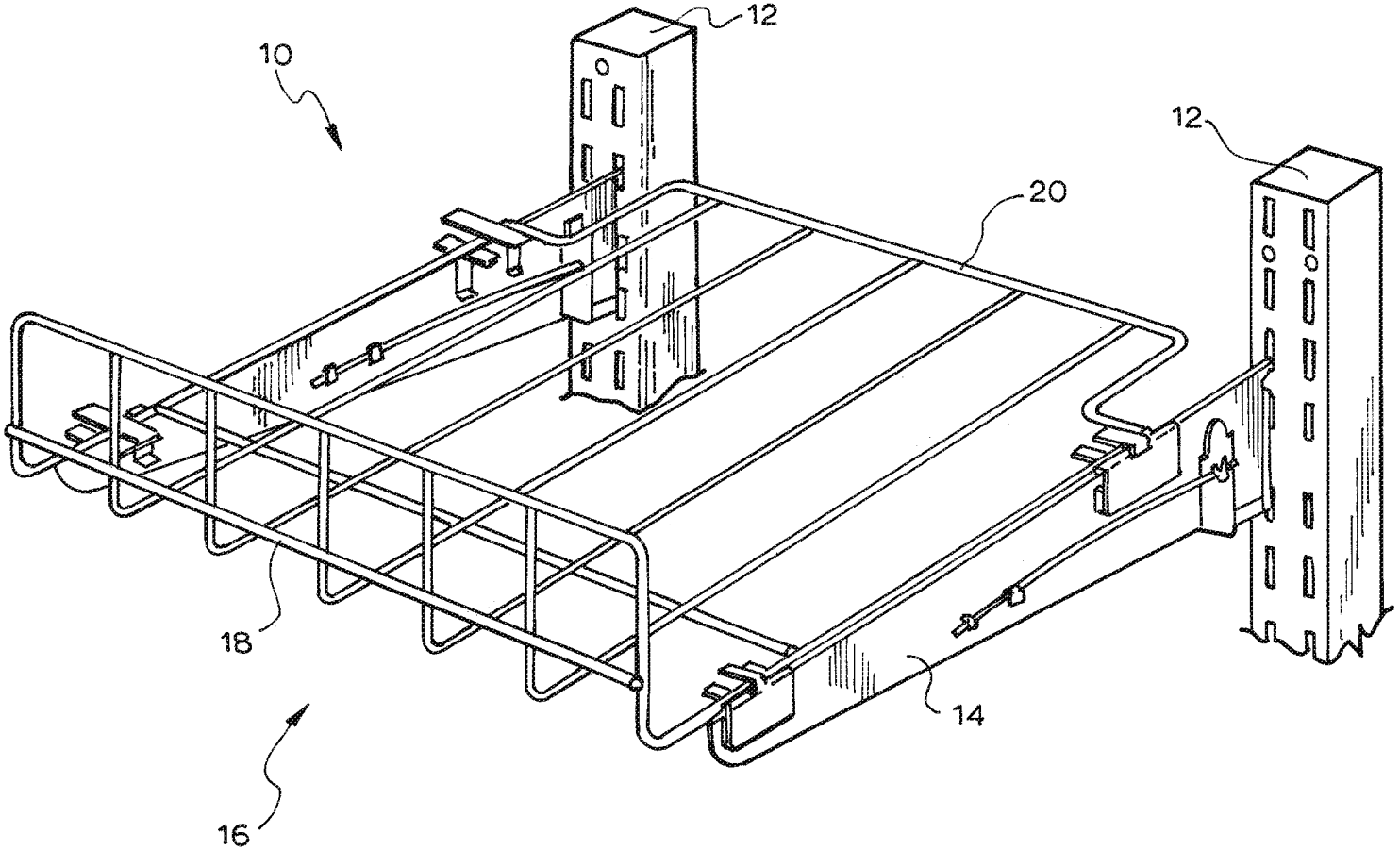
Fig.1 (Prior Art)
FIG. 1 is a perspective representation of a shelving system of the prior art.
Figure 2:
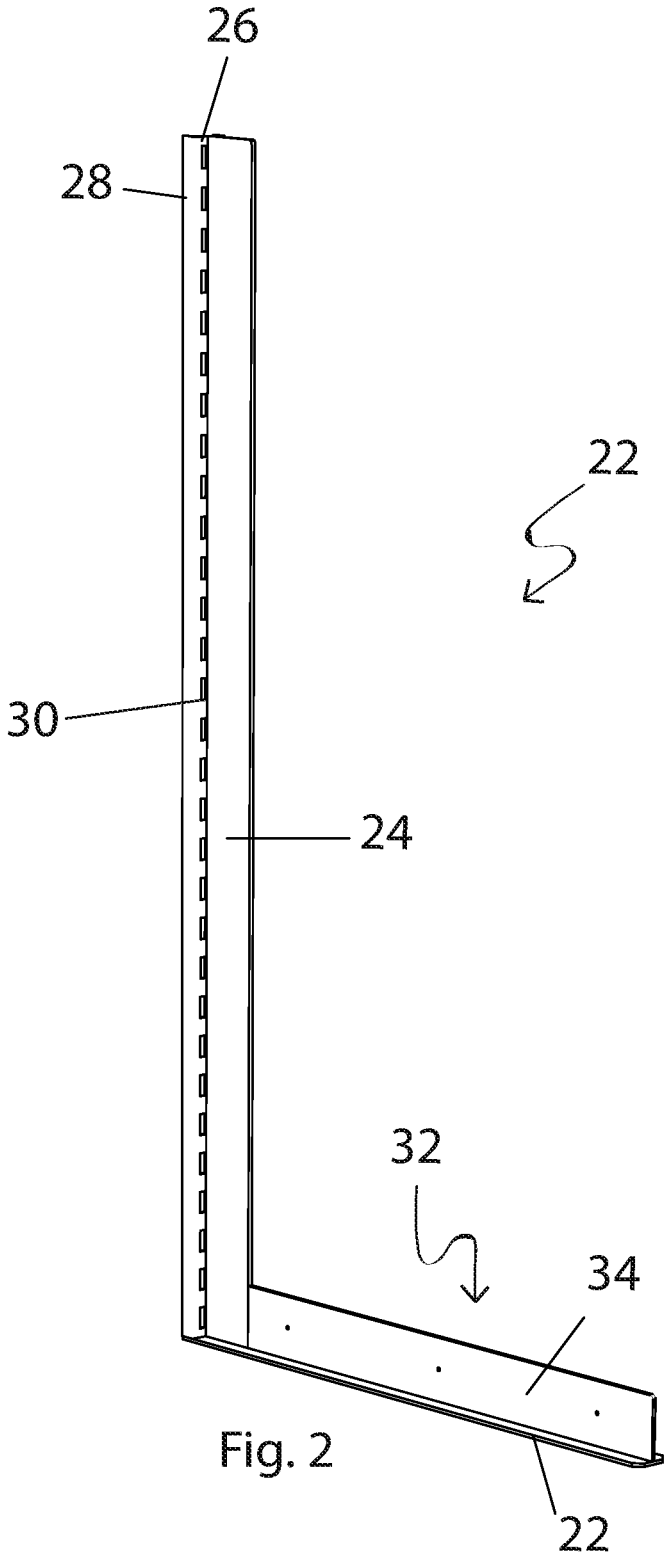
FIG. 2 is a perspective representation of a first embodiment of a shelving post.

FIG. 1 depicts a prior art shelving system 10. The shelving system 10 suffers from the problems set out in the background to the invention. In particular it features large posts 12 which support two horizontal supports 14 which in turn support shelf or rack 16. Due to the width and depth of the posts 12 the width of the rear of shelf or rack 18 is significantly narrower than the width of the front of the shelf or rack 20. Further as prior art shelving systems often incorporate shelves with support arms that themselves are quite big in their vertical dimension, it can be difficult to display products under such shelve support arms. So with respect to prior art system you lose space around the posts and under the shelve support arms. The present invention seeks to ameliorate these deficiencies of the prior art.

FIGS. 2 to 6 depict a shelving post 22 according to a first embodiment of the invention. The shelving post 22, when incorporated into a shelving system, obviates or significantly reduces the problems associated with prior art shelving systems. It does this by dispensing with RHS or SHS for the structural element of the helving posts. Instead the present embodiment uses flat or low profile members that have a planar protrusion or fin 24 that provides structural support, such that the overall width and depth of post 22 are reduced considerably, thereby reducing the dead space associated with prior art posts 12.

Figure 9:
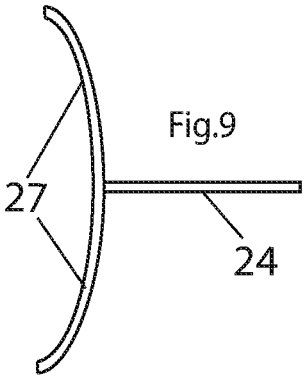
FIG. 9 is a cross section of a shelving post according to a second embodiment of the shelving post wherein the rear surface is curved.
Figure 10:
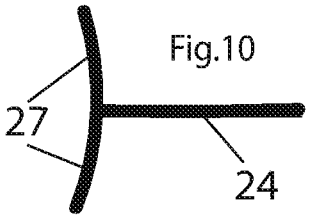
FIG. 10 is a cross section of a shelving post according to a third embodiment of the first aspect of the invention where the rear surface has less curvature.
Figure 14:
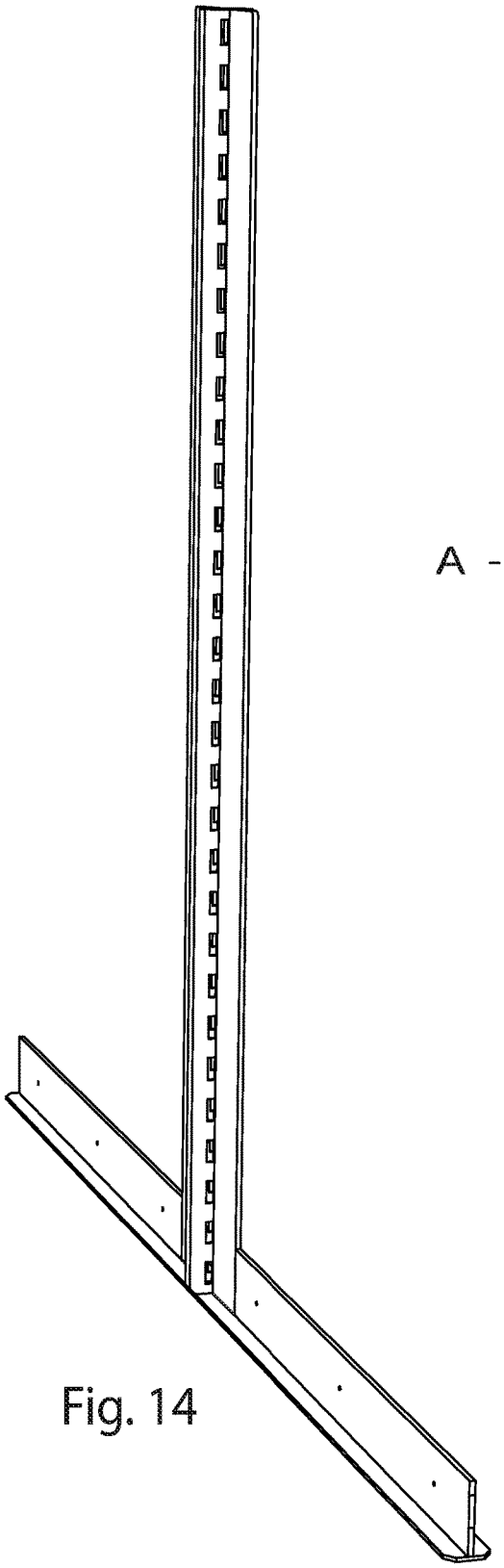
FIG. 14 is a perspective view of a sixth embodiment of the invention wherein it incorporates a double sided embodiment of the embodiment of FIG. 2.

Referring to FIGS. 2 to 6 the post 22 features a low profile rear support comprising front facing surface 26 and lug guard 28. The front facing surface has apertures 30 either side of fin 24 through which lugs 52 (from FIG. 7) on the shelf arms are supported and maintained. Lug guards 28 are preferably utilised so as to prevent the shelf post from being pressed up against a wall thereby causing the inserted lugs from being dislodged. However, in other embodiments such as the embodiment depicted in FIG. 13 the post 22 may be simply comprised of front facing surface 26 and fin 24 which forms a simple T shape. Alternatively, lug guards 28 and front facing surface 26 are replaced by curved and concave surface 27 in which apertures are formed as shown in FIGS. 9 and 10. In FIG. 10 the curvature formed on the rear face of the planar portion is slight and the lugs 52 remain exposed. In FIG. 9 the curvature is sufficient to create a space behind concave surface 27 in which the lugs would be protected from being dislodged if pushed against a wall.

In addition to the vertical members, the post 22 also has horizontal leg portion 32 which is in turn comprised of a leg fin 34 mounted upon a planar leg base 36. The fin 24 and leg fin 34 abut each other to provide further structural support.

Figure 7:
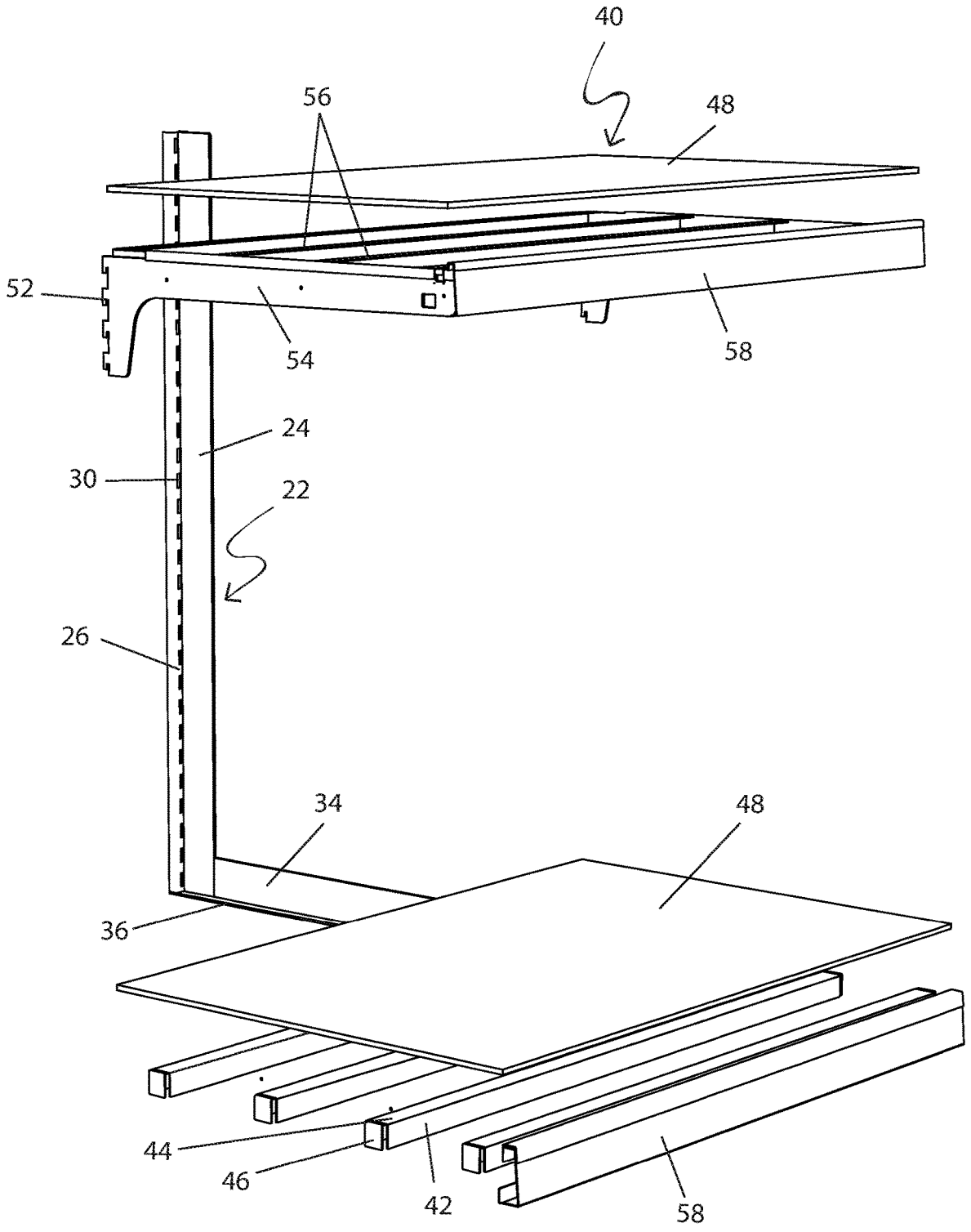
FIG. 7 is an exploded perspective view of a shelving system in a second aspect of the invention wherein the shelving system incorporates a shelving post of the first aspect of the invention of FIGS. 1 to 6 and a first embodiment of the shelf support (shown in FIG. 41)
Figure 8:
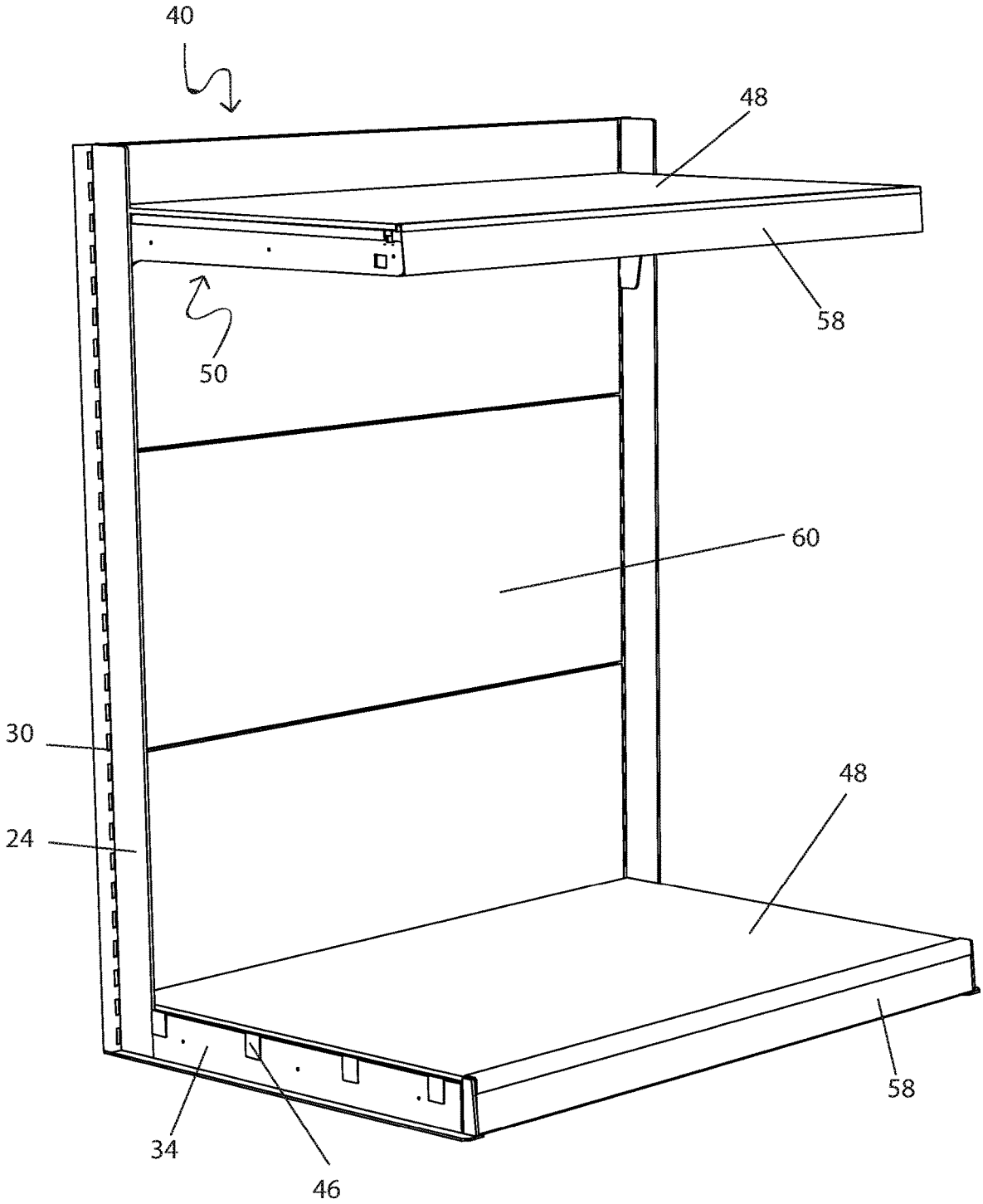
FIG. 8 is a perspective view of the assembled shelving system of FIG. 7.

Turning to FIGS. 7 and 8, they depict the second aspect of the invention, a shelving system 40, which incorporates post 22 of FIGS. 2 to 6. The system 40 is depicted with only one post 22 in FIG. 7 for simplicity however when assembled, as depicted in FIG. 8, two posts 22 are utilised in the provision of adjustable shelving. The components of shelving system 40 include bracing members 42 which are made from roll formed steel in a U shape with an open bottom and a planar top surface 44. The bracing members 42 further feature downwardly projecting tabs 46 which are adapted to extend over and be secured on leg fin 34. When bracing members are fitted over the leg fins 34 of two posts the top surfaces 44 create a flat surface for the support of a shelving surface 48 which can be fixed to the bracing members 42 in any number of conventional ways including screwing or gluing to form a bottom shelf.

There is also depicted in FIGS. 7 and 8 a shelf 50 that has a number of lugs 52 for insertion and retention within apertures 30. The lugs 52 are located on support arms 54 which are kept spaced apart by a plurality of shelf supports 56 in a similar fashion to the bracing members 42 of the bottom shelf. The shelf 50 also has a front fascia 58 that extends vertically beyond the support arms 54 such that when shelf surface 48 is overlaid, the top of the fascia 58 and shelf surface 48 form a level surface. Front fascia 58 can also be used as a ticket or signage holder.

It should be noted that persons skilled in the art would appreciate that the shelving system 40 can incorporate many different types of shelving including angled shelving where product slides or rolls (including those shelves that have small rollers) to the front of the shelf. The invention also incorporates shelves that are provided in modular form where separate arm brackets are used to support separate shelves (that is not integrally formed as in the case of shelf 50). Further the surface of the shelves may not be planar and may in fact be formed from wire or steel mesh or other materials or are otherwise adapted to have dividers and/or other retailing aids inserted or attached onto them.

Referring to FIG. 8 there is also depicted back panels 60 which also feature lugs 52 at their vertical edges. The back panels are inserted between two posts 22 when a retailer does not wish for the customer to see beyond the rear of the shelves in the shelving system 40. The back panels 60 also provide some structural integrity to the assembled shelving system as they brace the posts 22. When not utilised, they are often replaced by structural bracing members (not shown).

Shelving system 40 is designed such that a plurality of posts 22 can be utilised side by side creating extended shelf surfaces. By utilising posts 22 in the shelving system 40 it is now possible to have a shelf surface 48 which is the same width at the rear of the shelf as it is at the front of the shelf, eliminating dead space on the shelf. No unsightly indents are required to be formed into the shelf surface 48 in shelving system 40 as shown in FIG. 8 and wherein shelf surface 48 is maximised as compared to prior art shelving systems.

Figure 11:
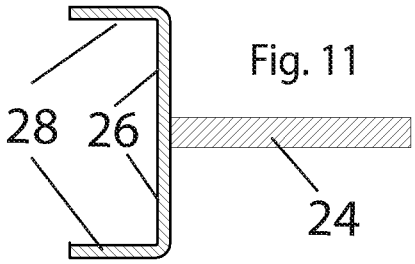
FIG. 11 is a cross section of a shelving post according to a fourth embodiment of the invention wherein the fin is shorter than in other embodiments.
Figure 12:
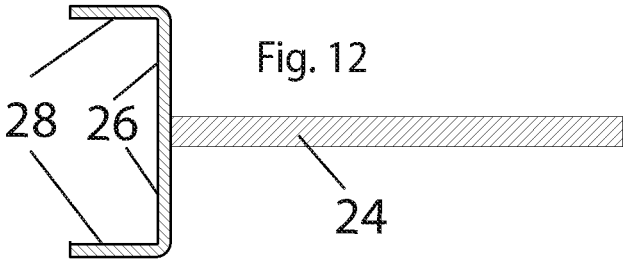
FIG. 12 is a cross section of a shelving post according to a fifth embodiment of the invention wherein the fin is longer than in other embodiments.
Figure 13:
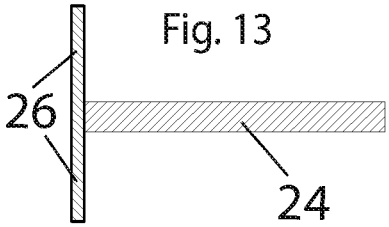
FIG. 13 is a cross section of a shelving post according to a sixth embodiment of the invention wherein the rear surface has no returns.
Figure 15:
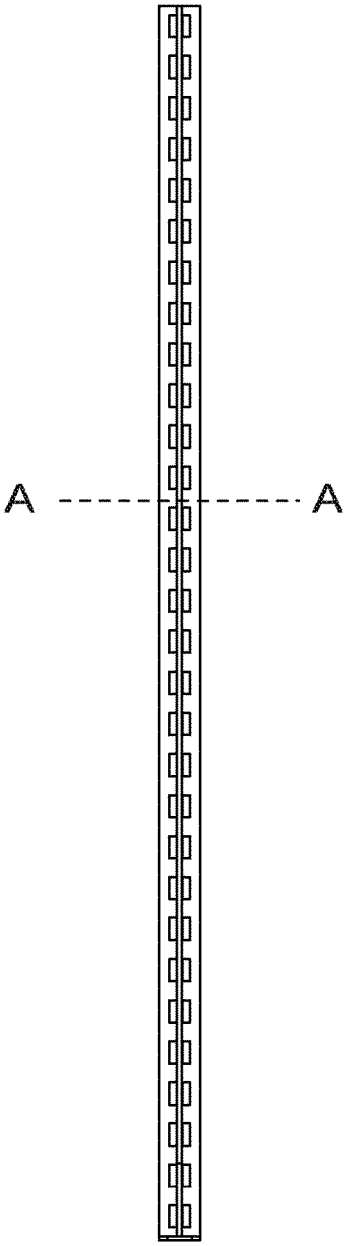
FIG. 15 Is a front view of the shelving post of FIG. 14.
Figure 16:
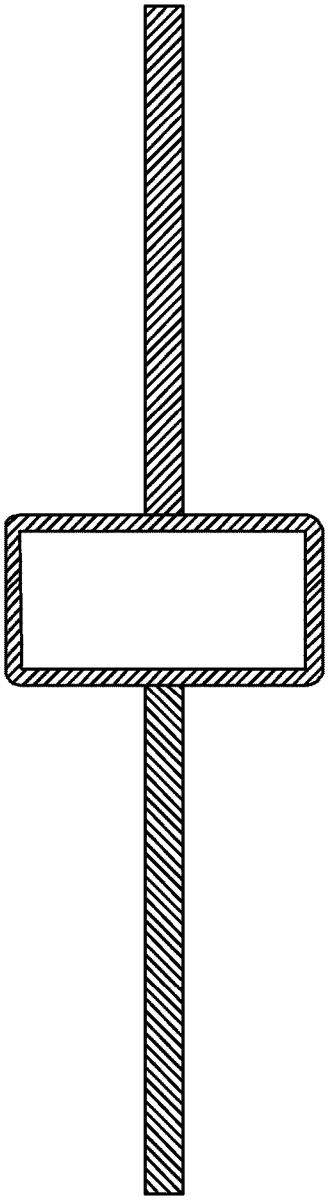
FIG. 16 Is a cross section view along line A-A of FIG. 15.
Figure 17:
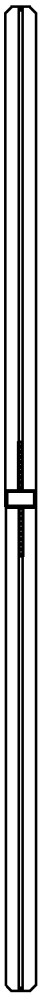
FIG. 17 Is a top view of the shelving post of FIG. 14.
Figure 18:
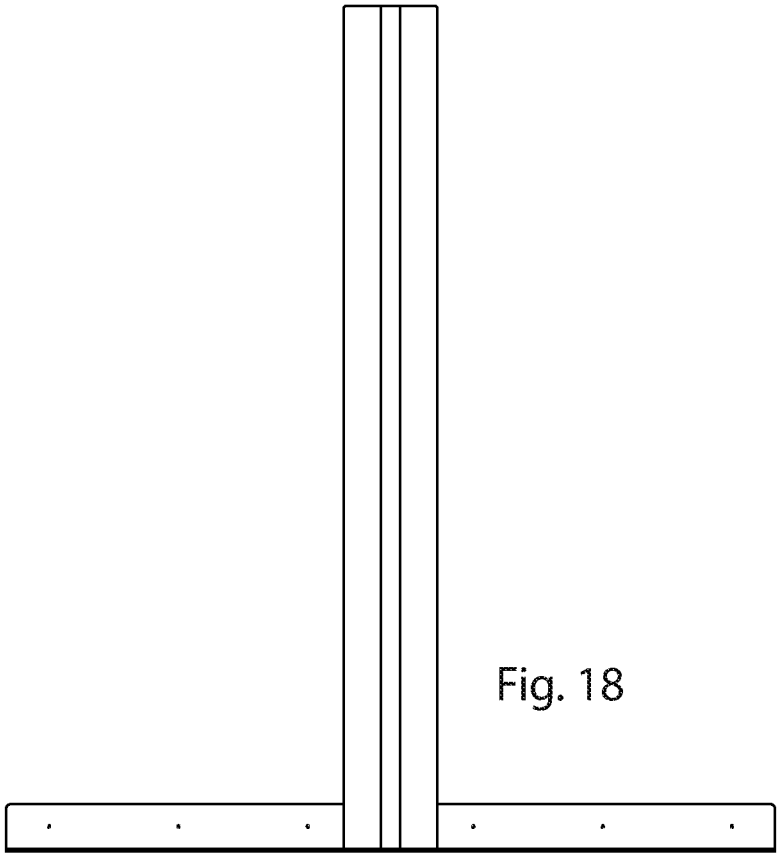
FIG. 18 Is a side view of the shelving post of FIG. 14.
Figure 20:
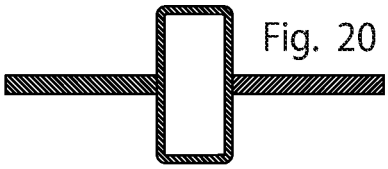
FIG. 20 Is a cross sectional view of a post according to an eighth embodiment of the invention in which the fin is shorter than in the embodiment shown in FIG. 16.
Figure 19:
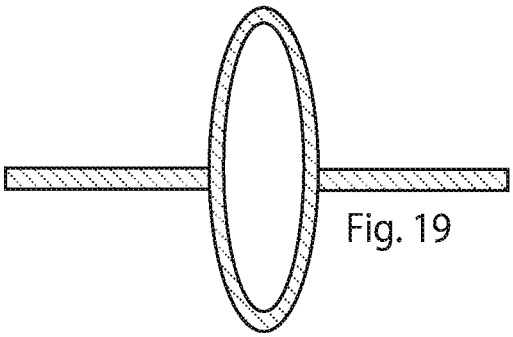
FIG. 19 Is a cross sectional view of a post according to a seventh embodiment of the invention in which the central portion is a flattened steel tube.
Figure 21:
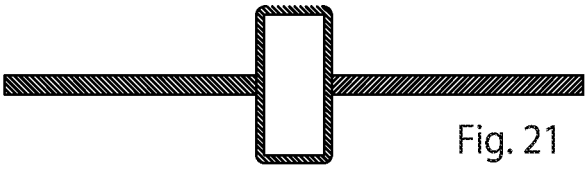
FIG. 21 Is a cross sectional view of a post according to an eighth embodiment of the invention in which the fin is longer than in the embodiment shown in FIG. 16.
Figure 22:
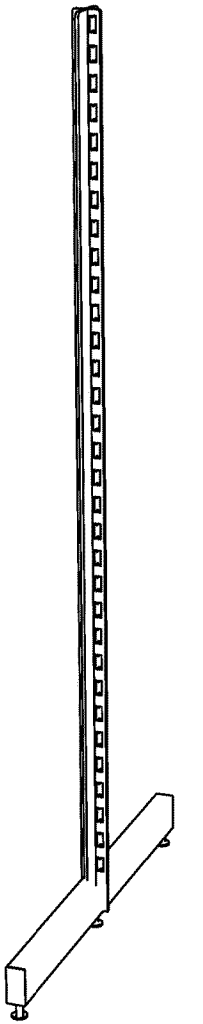
FIG. 22 Is a perspective view of a ninth embodiment of the invention which is a double sided version of the 6th embodiment of the shelving post aspect of the invention.
Figure 27:
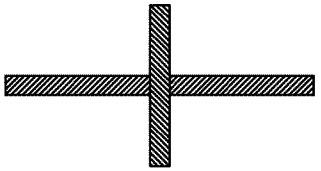
FIG. 27 Is a cross section of the shelving post of FIG. 22.
Figure 23:
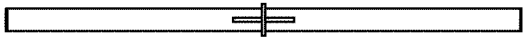
FIG. 23 Is a top view of the shelving post of FIG. 22.
Figure 26:
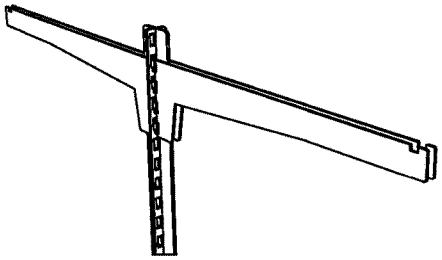
FIG. 26 Is a perspective close up view of the connection between the shelving post of FIG. 27 and support arms.
Figure 24:
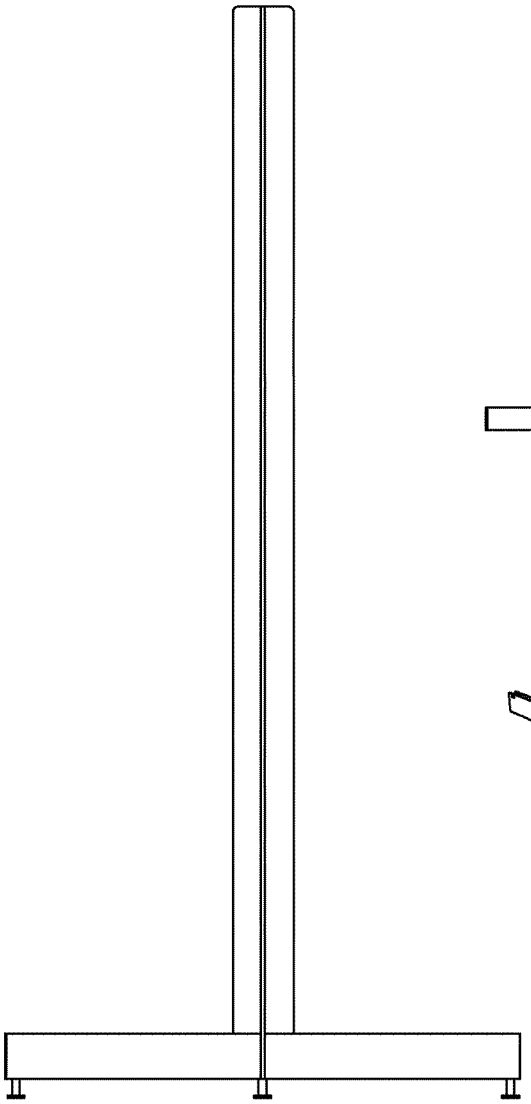
FIG. 24 Is a side view of the shelving post of FIG. 22.
Figure 25:
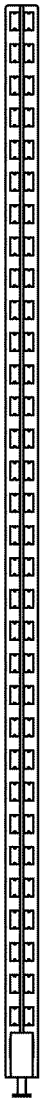
FIG. 25 Is a front view of the shelving post of FIG. 22.

Reference is now made to FIGS. 11 to 13 in which cross sections of second through fifth embodiments of posts 22 are depicted. The embodiments differ with regard to the length and width of fin 24. The depicted embodiments are not exhaustive of the embodiments of the invention that fall within the scope of the invention and are provided for illustrative purposes only. In terms of ratios of fin length to fin width the depicted figures show a ratio of between 8:1 for FIG. 11 and 15:1 for FIG. 12. In terms of absolute widths and lengths, the invention encompasses fins of the following dimensions: 4 mm×60 mm, 6 mm×60 mm, 6 mm×80 mm, 6 mm×100 mm, 8 mm×80 mm, 8 mm×100 mm, 8 mm×120 mm. The longer the fin 24, the greater weight can be accommodated on the supported shelves. In terms of the weight that can be supported by shelf 50 as depicted in FIG. 8 a minimum of 300 KG can be supported using an 8 mm×80 mm sized fin 24.

Figure 28:
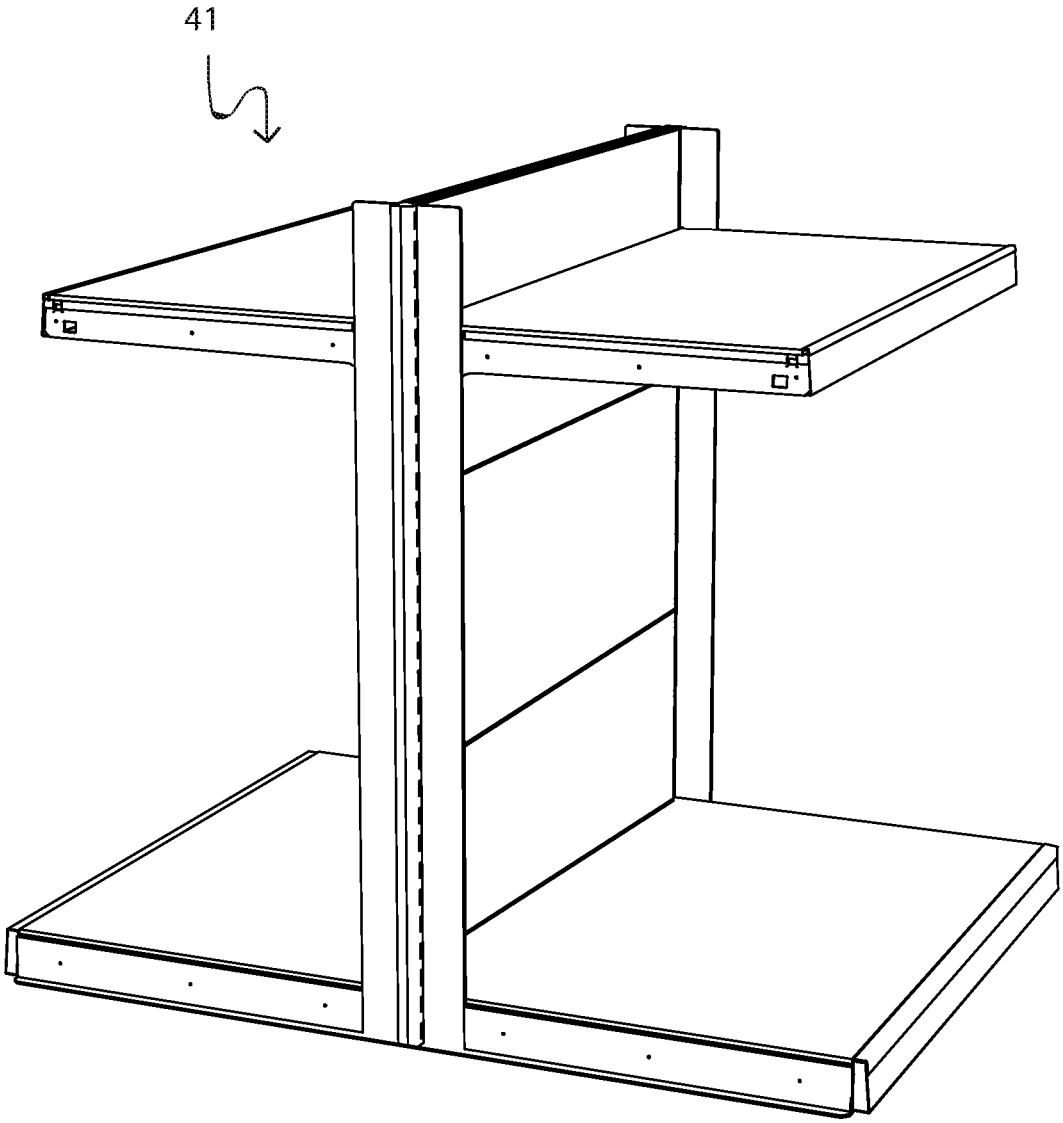
FIG. 28 Is a perspective view of a shelving system in which a post of the FIG. 14 is incorporated.

Turning to FIG. 14 to FIG. 21 the shelving post and system depicted in the figures is a double sided version of the shelving posts and system depicted in FIGS. 1 to 13. A double sided embodiment allows for further space saving by only having the one central post support shelves on either side of the post. A depiction of the assembled system 41 is shown in FIG. 28. FIGS. 22 to 27 also represent an alternative double sided embodiment. In this latter embodiment the post comprises a star shaped post without any rectangular or hollow section that may take up valuable product display space.

Figure 32:
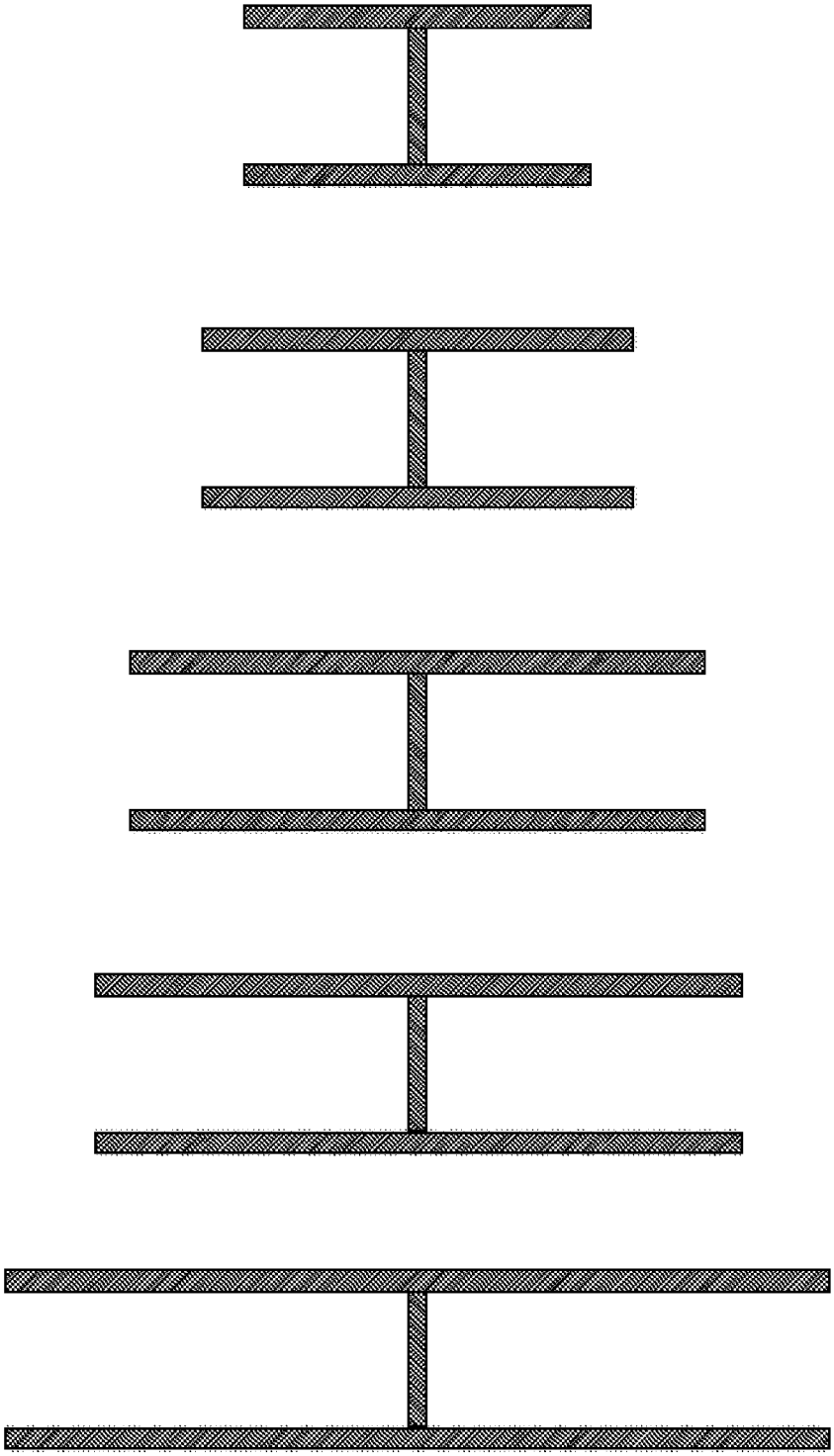
FIG. 32 Are depictions of cross sections in accordance with still further embodiments of the invention in which there is a single rear surface containing apertures.
Figure 33:
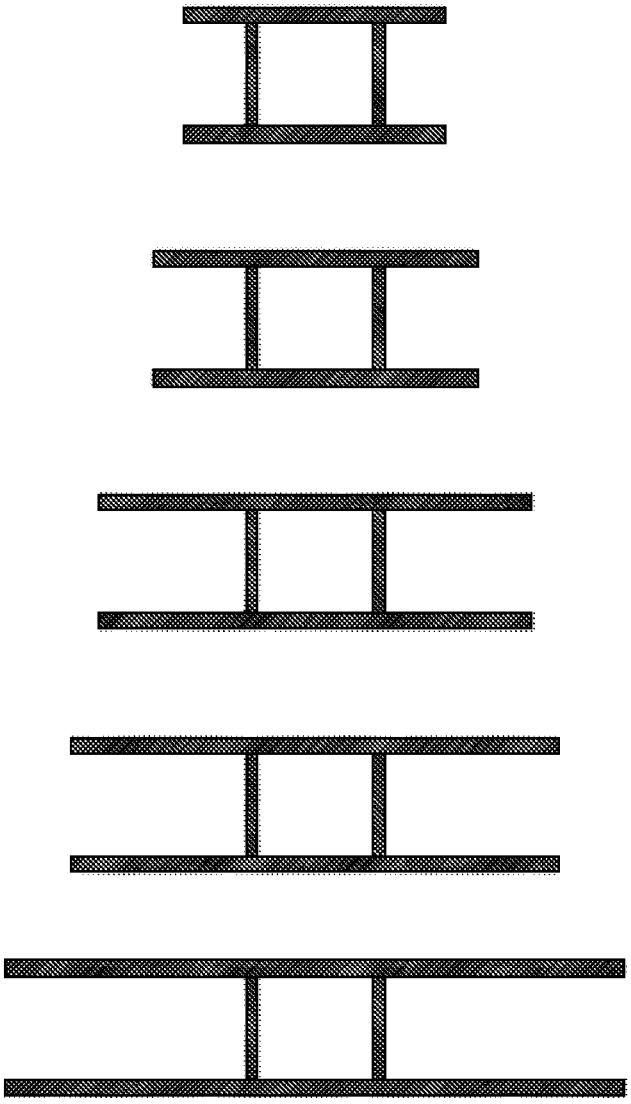
FIG. 33 Are depictions of cross sections in accordance with still further embodiments of the invention in which there are two rear surface containing apertures connected to two parallel fins.
Figure 39:
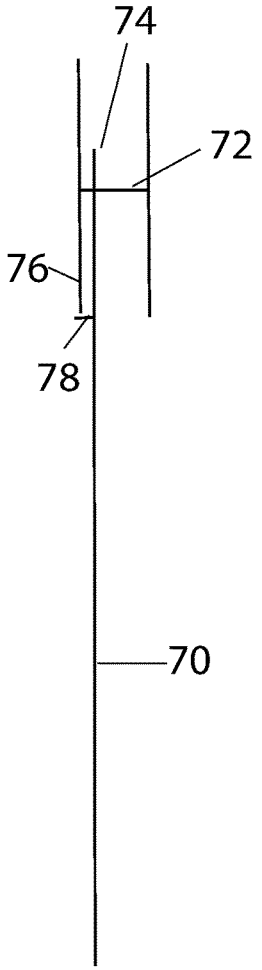
FIG. 39 Is a schematic top view of further embodiment of a shelving system comprising a first embodiment of a shelf support.
Figure 40:
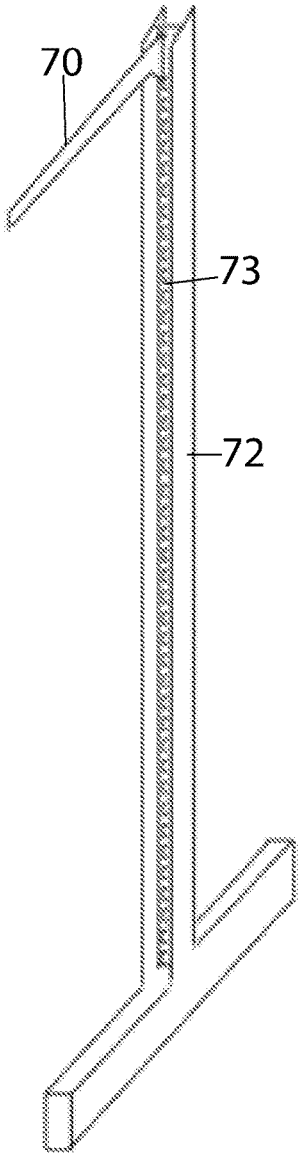
FIG. 40 Is a perspective view of the shelving system of FIG. 39.
Figure 42:
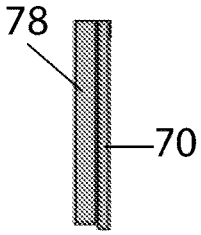
FIG. 42 Is a front view of the shelving support of FIG. 39.
Figure 43:
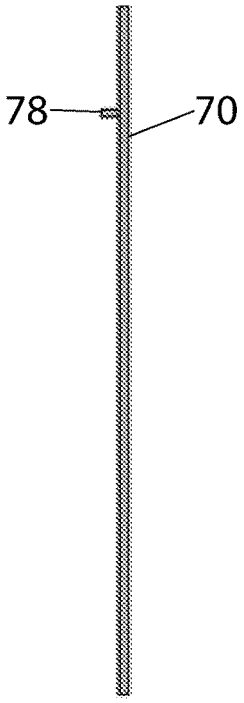
FIG. 43 Is a top view of the shelving support of pf FIG. 39.
Figure 41:
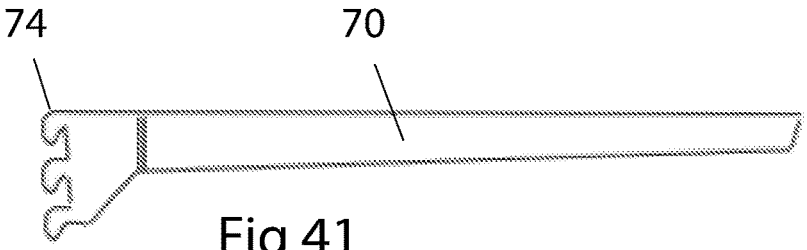
FIG. 41 Is a side view of the shelving support of FIG. 39.
Figure 44:
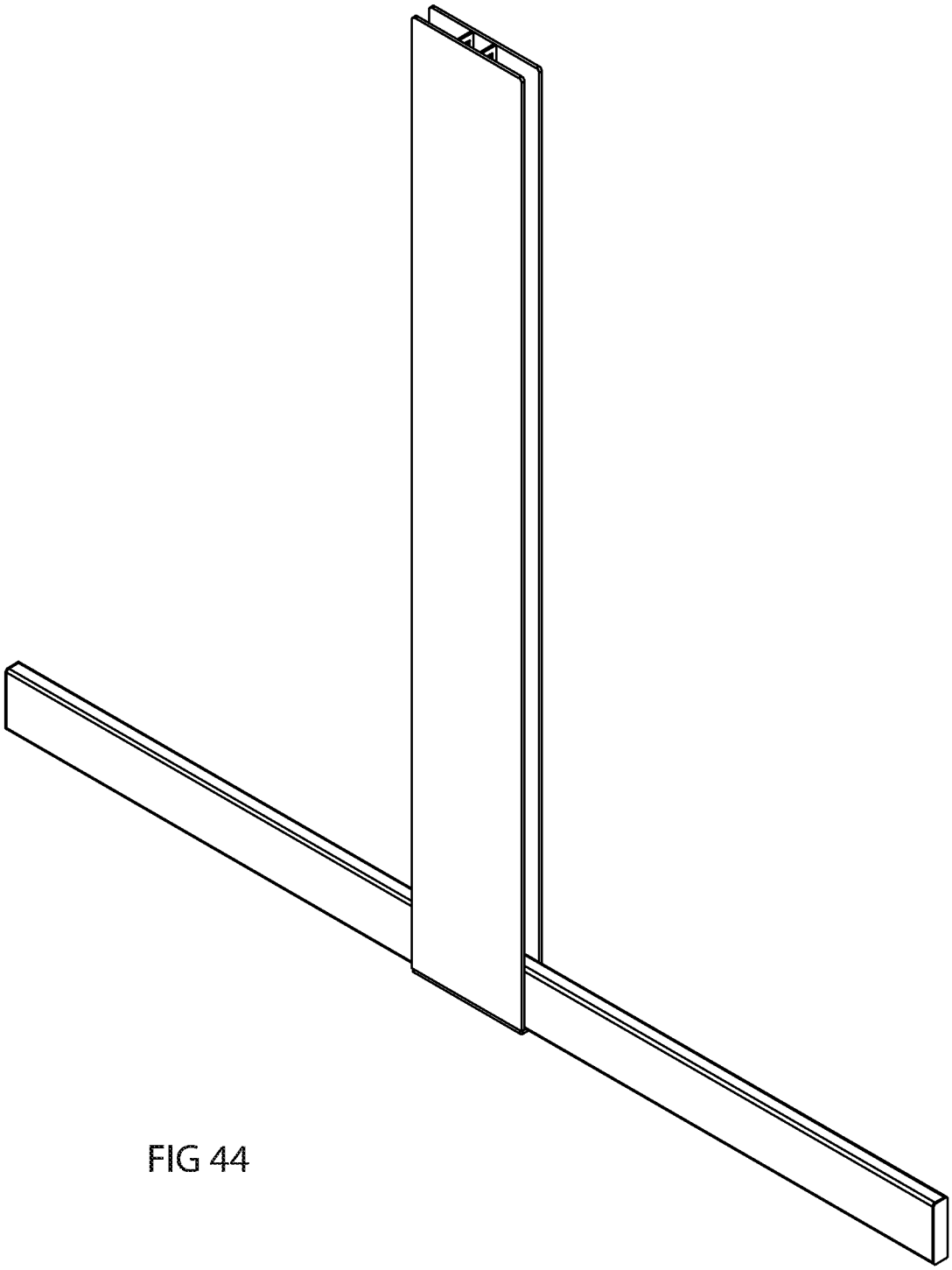
FIG. 44 Is a perspective view of the shelving post according to a still further embodiment of the shelving post aspect of the invention.
Figure 47:
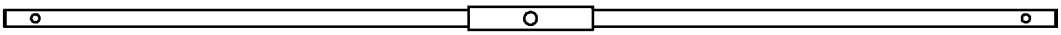
FIG. 47 Is a bottom view of the shelving post of FIG. 44.
Figure 46:
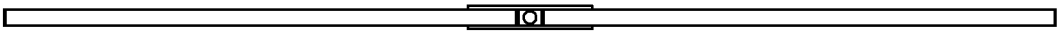
FIG. 46 Is a top view of the shelving post of FIG. 44.
Figure 48:
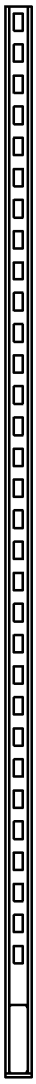
FIG. 48 Is a front view of the shelving post of FIG. 44.
Figure 45:
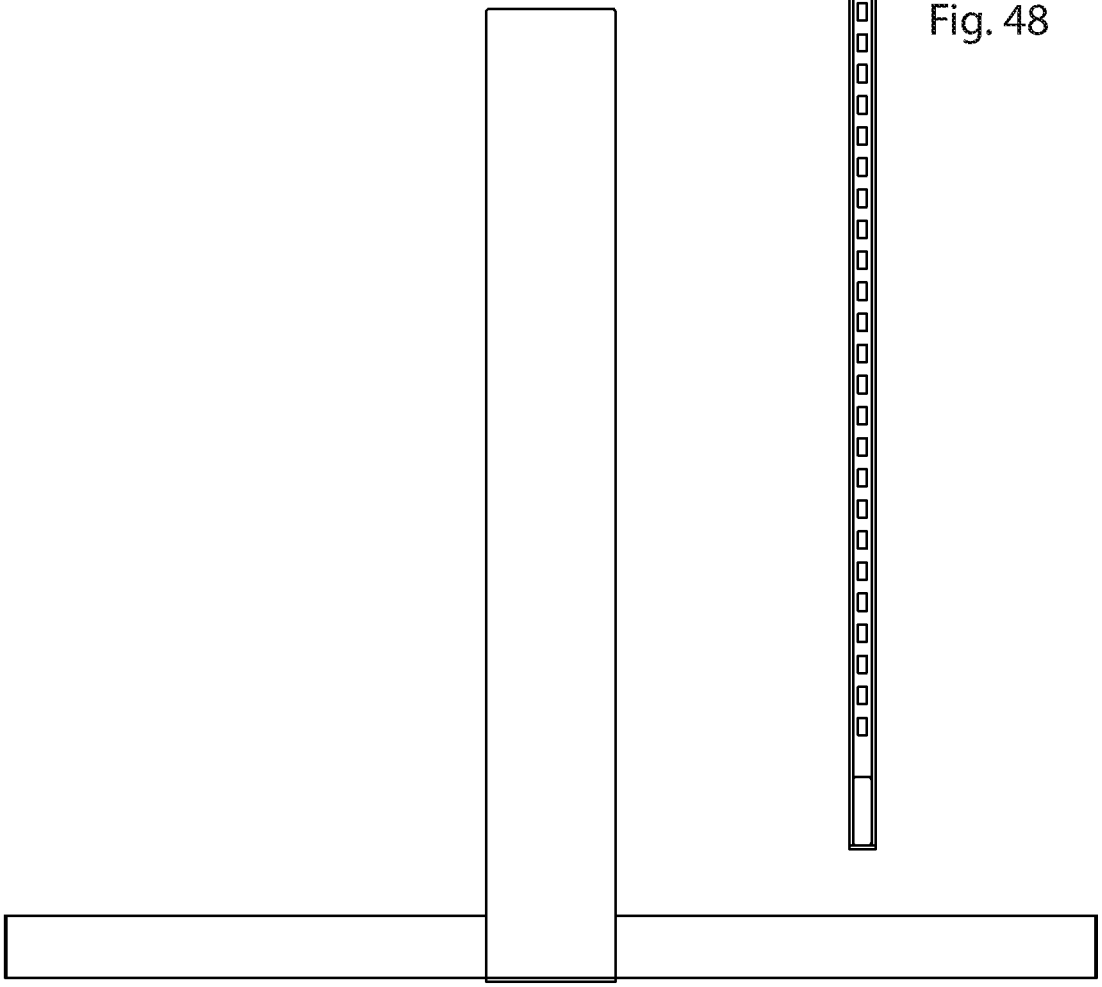
FIG. 45 Is a side view of the shelving post of FIG. 44.

FIGS. 29 to 31 depict an eleventh embodiment of a shelving post, the third embodiment that is also double sided. The shelving post is H shaped as depicted in the cross section shown in FIG. 31 and those in FIGS. 32 and 33 which shows multiple variations of the post of FIG. 31. As such, the H shaped shelving post has two vertical parallel spaced apart planar portions (i.e., "legs" of the "H" shape). These parallel spaced apart planar portions are provided as fins 72. As shown in FIG. 31, a planar cross member extends between the parallel spaced apart planar portions. The planar cross member is the "waist" of the "H" shape. The parallel spaced apart planar portions are maintained in their spaced apart and parallel configuration by the planar cross member.

The post of FIG. 29 is shown in FIGS. 34 to 38 together with second embodiment of the shelving support (arm). In FIGS. 34 and 35 shelving support 70 is connected to shelving post 72 via lugs 74 which are inserted into apertures 73 of the shelving post 72. To provide additional support and stability a vertical stop 78 is provided on the support 70 such that when supported in the post 72 by the lugs 74 the vertical stop 78 sits flush with and is supported by post fin 76 (as shown in FIGS. 34 and 35). In addition to the vertical stop 78 providing additional support, a return 80 is provided on the top surface of support 70 so as to provide additional resilience against bending when forces are applied to the top surface of 70. The additional support provided by the vertical stop 78 and return 80 allows the support 70 to adopt a very low vertical profile, thereby freeing up space that would otherwise be unavailable under the support in a conventional shelving system. The same arrangement is observed for the support and post depicted in FIGS. 39 to 43 except that the support 70 does not have a return 80. This reduces the load that can be carried comparatively to the support depicted in FIGS. 34 to 38 however it is still sufficient to provide the support required to lower the vertical profile of support 70 thereby providing additional room for product to be displayed under the support 70.

INDUSTRIAL APPLICABILITY

The present invention has industrial applicability in the field of retail display shelving for use in displaying and retailing goods including heavy goods.

The invention claimed is:

1. A shelving post for use in supporting a shelf of an adjustable shelving system wherein the shelving post comprises a base member and a vertical member wherein the vertical member comprises two vertical parallel spaced apart planar fins which are maintained in their spaced apart and parallel configuration by at least one planar cross member having a rear face and a front face with a plurality of apertures formed therethrough and wherein lugs of a shelf support forming part of the adjustable shelving system are adapted to be inserted into and be supported by the apertures of the cross member, and wherein the vertical member is connected to the base member to support the vertical member, wherein there are two cross members disposed between the two fins.

2. The shelving post of claim 1 wherein there are apertures in both cross members and wherein the lugs of a shelf support forming part of the adjustable shelving system are adapted to be inserted into and be supported by the apertures of the cross members.

3. The shelving post of claim 1 wherein the distance or space between the two fins is less than the width of the fins.

4. The shelving post of claim 3 wherein the distance or space between the two fins is less than half the width of the fin or fins.

5. An adjustable shelving system comprising a shelving post for use in supporting a shelf of an adjustable shelving system wherein the shelving post comprises a base member and a vertical member wherein the vertical member comprises two vertical parallel spaced apart planar fins which are maintained in their spaced apart and parallel configuration by at least one planar cross member having a rear face and a front face with a plurality of apertures formed therethrough and wherein lugs of a shelf support forming part of the adjustable shelving system are adapted to be inserted into and be supported by the apertures of the cross member, and wherein the vertical member is connected to the base member to support the vertical member, together with a plurality of shelf supports that have a planar body having a plurality of lugs, wherein the shelf supports are supported by the lugs when inserted into the apertures of the shelving post, wherein the plurality of shelf supports have a vertical stop that is located on at least one side of the shelf support, wherein the vertical stop is adapted to supported by one of the fins when inserted into the shelving post, so as to provide the shelf support with additional support.

6. The adjustable shelving system of claim 5 wherein the shelf support additionally comprises a second planar portion connected perpendicularly to the body and wherein the second planar portion provides additional rigidity to the plurality of shelf supports.

* * * * *